US006695638B1

(12) United States Patent
David

(10) Patent No.: US 6,695,638 B1
(45) Date of Patent: Feb. 24, 2004

(54) ELECTRICAL WIRE CONNECTOR DEVICE

(76) Inventor: Daniel N. David, 25 Roble Rd., Berkeley, CA (US) 94705

( * ) Notice: Subject to any disclaimer, the term of this patent is extended or adjusted under 35 U.S.C. 154(b) by 228 days.

(21) Appl. No.: 09/853,820

(22) Filed: May 11, 2001

(51) Int. Cl.[7] ..... H01R 4/24
(52) U.S. Cl. ..... 439/441; 439/822; 439/787
(58) Field of Search ..... 439/439, 440, 439/441, 786, 787, 822

(56) References Cited

U.S. PATENT DOCUMENTS

| | | | | | |
|---|---|---|---|---|---|
| 4,759,725 | A | * | 7/1988 | Finch | 439/439 |
| 5,320,558 | A | * | 6/1994 | von Roretz | 439/441 |
| 5,807,133 | A | * | 9/1998 | Arnett | 439/441 |
| 5,993,245 | A | * | 11/1999 | Osada | 439/441 |
| 2001/0010981 | A1 | * | 8/2001 | Cutler et al. | |

FOREIGN PATENT DOCUMENTS

| | | | |
|---|---|---|---|
| EP | 464752 | * | 1/1992 |
| GB | 2049307 | * | 12/1980 |
| GB | 2204748 | * | 11/1988 |

* cited by examiner

*Primary Examiner*—Neil Abrams
(74) *Attorney, Agent, or Firm*—Haverstock & Owens LLP

(57) ABSTRACT

The invention relates to a wire connector for connecting two or more wires of same or different wire gauges. The wire connector has a body, a first set of fingers, a second set of fingers, and a resilient means for keeping the first set of fingers and the second set of fingers in contact with one other. Each finger in a set has an end which serves as the connection point between the connector and the wires that are inserted. Each set of fingers extend from the body along a plane such that the ends of each set are in contact. Each finger also has a spring urge characteristic such that the finger will apply a resulting tension bias upon an object which causes the finger to move. Thus, wires of different gauges are inserted and held in the connector because the opposing fingers from each set provide an individual spring urged fit to each wire. Each set of fingers may be configured to extend at an angle relative to the plane, inwardly toward the body. With this configuration, wires of different gauges are inserted by applying a force to the fingers in each set. The spring urge characteristics of each finger hold the wires in place, thus allowing electricity to flow between the wires. Alternatively, a plate may be used instead of one set of fingers to allow the connector to be attached to other surfaces, and the fingers may alternatively include an insulation piercing configuration.

28 Claims, 6 Drawing Sheets

ELECTRICAL WIRE CONNECTOR DEVICE

BACKGROUND OF THE INVENTION

This invention relates to connectors of the type employed for simultaneously connecting multiple wires of the same or different gauges.

It is known to use conical wire nuts to connect and secure multiple wires. To use a wire connector, the user first twists two wires together. The user then takes the twisted wires and inserts the wires into the wire nut in a twisting motion. Although the wire nut is a common and effective way of securing connection between two wires, there are many disadvantages to using a wire nut. For instance, the user twists the two wires together before inserting them into the wire nut. In consequence, the user is forced to untangle the wires if he or she chooses to remove them from the wire nut. Further, a wire nut may not be the best device for connecting wires of different gauges, because wires are usually secured to the wire nut by a snug fit.

Thus, it has long been desired to find an inexpensive way to connect two or more wires, whereby each wire may have a different gauge, in such a way that it is easy for the user to insert and remove the wires without having to twist them together before inserting them into the connector.

The present invention may be used in a variety of applications in which a connection between two or more wires is needed. The invention may be used by itself as a connector for multiple wires or it may be used in combination with other components of a system in which electrical connections are required and utilized.

SUMMARY OF THE INVENTION

The invention relates to a wire connector for connecting two or more wires of same or different wire gauges. The wire connector has a body, a first set of fingers, a second set of fingers, and a resilient means for keeping the first set of fingers and the second set of fingers in contact with one other. Each finger in a set has an end which serves as the connection point between the connector and the wires that are inserted. Each set of fingers extend from the body along a plane such that the ends of each set are in contact. Each finger also has a spring urge characteristic such that the finger will apply a resulting tension bias upon an object which causes the finger to move. Thus, wires of different gauges are inserted and held in the connector because the opposing fingers from each set provide an individual spring urged fit to each wire. Each set of fingers may be configured to extend at an angle relative to the plane, inwardly toward the body. With this configuration, wires of different gauges are inserted by applying a force to the fingers in each set. The spring urge characteristics of each finger hold the wires in place, thus allowing electricity to flow between the wires. Alternatively, a plate may be used instead of one set of fingers to allow the connector to be attached to other surfaces.

A connector comprising a first set of spring urged fingers configured along a plane where each finger in the first set has an end. The connector also comprises a second set of spring urged fingers, where the first and the second set is configured parallel to or at an angle about the plane. Each finger in the second set has an end such that ends of the second set are aligned substantially in the line and in contact with one or more of the ends of the first set, forming an electrical node. The connector also comprises a resilient means for urging the ends of the first set into contact with the ends of the second set, such that two or more wires are separately insertable between the first set and the second set, wherein the wires have substantially a same electrical potential.

A connector comprising a first set of spring urged fingers that is configured along a plane where each finger in the first set has an end. The connector also comprises a second set of spring urged fingers, where the second set is configured along the same plane as the first set. Each finger in the second set has an end such that ends of the second set are substantially aligned in a line and in contact with the ends of the first set, thus forming an electrical node. Also, the connector comprises a resilient means for urging the ends of the first set into contact with the ends of the second set. So, two or more wires, having a substantially same electrical potential, are separately insertable between the first set and the second set, which causes the ends of the first set and the ends of the second set to engage the wires.

A connector comprising a body having a set of spring urged fingers configured along a plane, where each finger in the set has an end such that ends of the set are aligned substantially in a line. The body has a plate in contact with the ends of the set such that the set and the plate form an electrical node. The body has a resilient means for urging the contact between the ends of the set and the plate such that a first wire having a first gauge is insertable between the set and the plate. A second wire having a second gauge is separately insertable between the set and the plate, wherein the first wire and second wire are substantially at a same electrical potential.

A method of connecting a plurality of wires comprising the steps of providing a first set of spring urged fingers, the first set in electrical contact with one another, where each finger in the first set has an end, such that ends of the first set are aligned substantially in a line. The method also comprises providing a second set of spring urged fingers, the second set in electrical contact with one another and with the first set such that the first set and the second set form an electrical node. Each finger in the second set has an end, such that ends of the second set are aligned substantially in the line and in contact with one or more of the ends of the first set. The method also comprises urging the ends of the first set into contact with the ends of the second set such that a first wire having a first gauge is insertable by pressure between the first set and the second set and a second wire having a second gauge is separately insertable by pressure between the first set and the second set and the first wire and second wire are substantially at a same electrical potential. Other advantages and features of the present invention will be readily apparent from the foregoing detailed discussion of the present invention.

DETAILED DESCRIPTION OF THE DRAWINGS

Figure 1A:
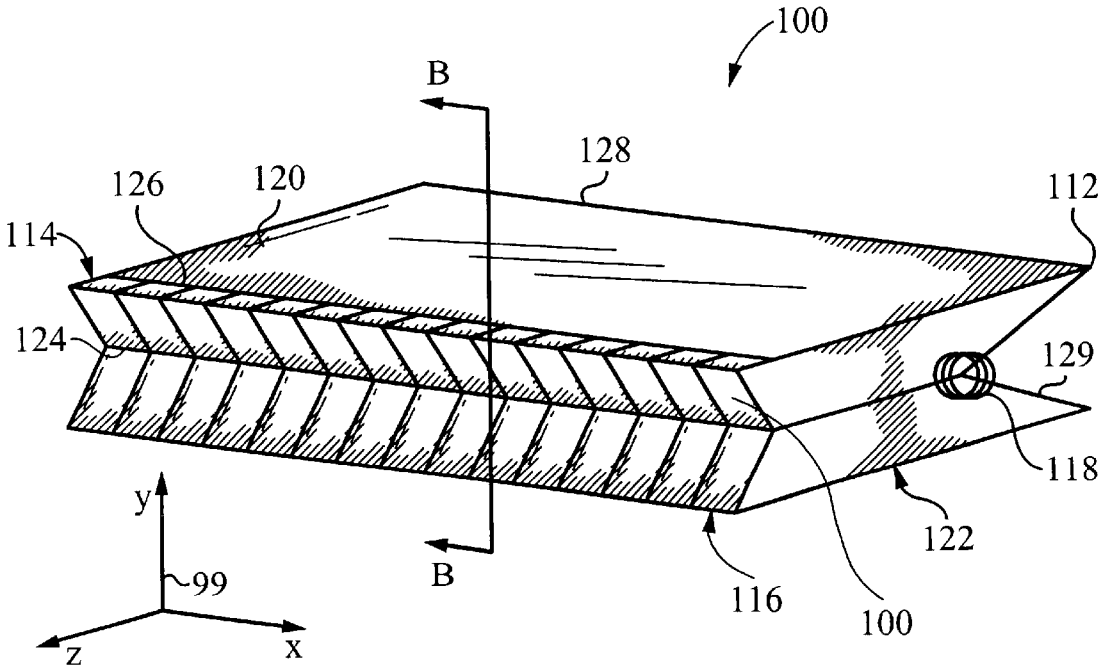
FIG. 1*a* shows an isometric view of the preferred embodiment of the connector with fingers in the first set and the second set at an angle $\alpha$ about plane 99.

FIG. 1*a* represents the preferred embodiment of the wire connector 100 in accordance with the present invention, which has a body 112, a first set of fingers 114, a second set of fingers 116, and a resilient means 118 for keeping the first set of fingers 114 and the second set of fingers 116 in contact with one other.

Specifically, the body 112 has a top face 120 having a top front edge 126 and a top back edge 128. Also, the body 112 has a bottom face 122 having a bottom front edge 127 and a bottom back edge 129. The top front edge 126 has a first set of fingers 114 extending from it and the bottom front edge 127 has a second set of fingers 116 extending from it. It is preferred that there are an equal number of fingers 110 in the first set 114 and the second set 116, however it is not required. Each finger 10 has an end 124 which serves as the connection point between the connector 100 and the wires that are inserted. Each finger 110 has a spring urge characteristic such that the finger 110 will apply a resulting tension bias upon an object which causes the finger 110 to bend.

Figure 1B:
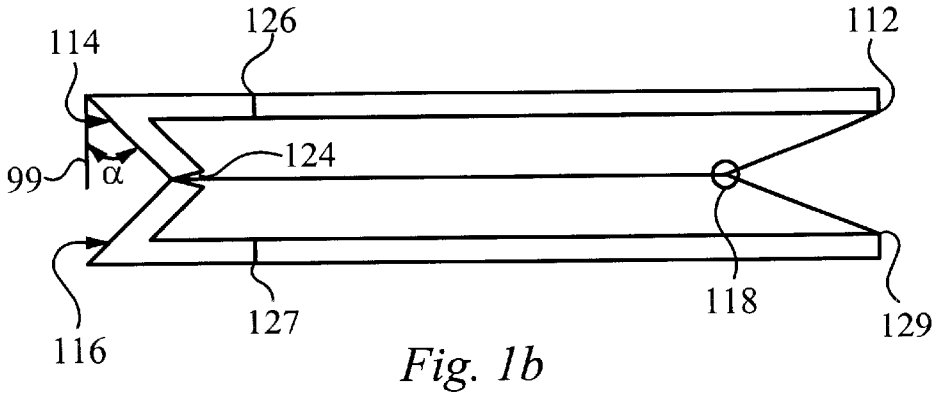
FIG. 1*b* is a cross-sectional view of the connector in FIG. 1*a* along lines B—B.

In FIG. 1*b*, a cross sectional view along line B—B of the connector 100 illustrates that the first set of fingers 114 extends from the top front edge 126 and is configured at an angle α relative to the XY plane 99. Similarly, the second set of fingers 116 extends from the bottom front edge 127 and is configured at an angle α relative to the plane 99 such that the ends 124 of first set 114 and second set 116 are in contact.

It is preferred that the ends 124 for both sets of fingers are substantially aligned in a line, however it is not required. Each finger should be in direct electrical contact with each other in a set to form an electrical node and allow current to pass through the connector 100. It is preferred that each finger 110 in a set have a width smaller than the diameter of each wire being inserted. However, the width of each finger 110 may be larger than each wire diameter, depending on the application. When the width of the finger 110 is larger than the diameter of the wire, care must be taken to ensure good electrical connection to all wires.

Usually, insulation around the wire must be removed before the wire is inserted into the connector 100. This is usually done manually by "stripping" the wire. Alternatively, the connector 100 can be configured to make electrical contact without stripping the insulation surrounding the wire. Specifically, the ends [124] of the fingers [110] are pointed 324A (FIG. 3B), sharpened or serrated 324B (FIG. 3B), such that the fingers [100] penetrate the insulation around the wire and make contact with the conductive part of the wire.

Figure 1C:
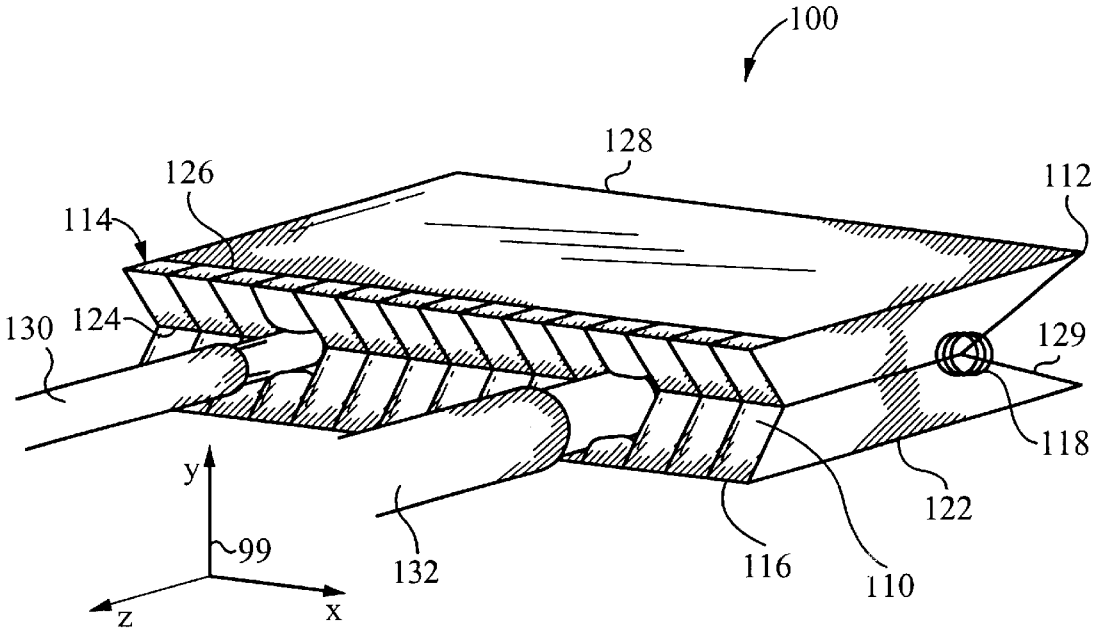
FIG. 1*c* shows an isometric view of the preferred embodiment of the connector with fingers in the first set and the second set at an angle $\alpha$ about plane 99 with two wires of different gauge diameters inserted.
Figure 1D:
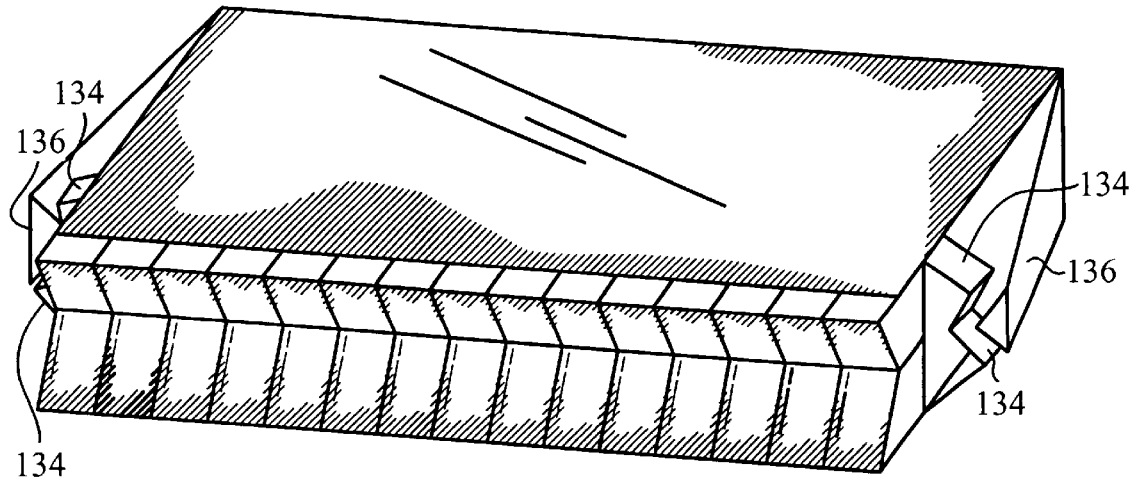
FIG. 1*d* shows an isometric view of an alternate embodiment of the present invention.

Further, a resilient means urges the ends 124 of the fingers 110 in the first set 114 to be in contact with the ends 124 of the fingers 110 in the second set 116. Preferably, the resilient means is a coil spring mechanism incorporated in the body 112 about a pivotal point, shown at 118. However, other body configurations can be utilized to act as an equivalent substitute for urging the ends of first set of fingers 114 to be in contact with the ends of the second set of fingers 116. For instance, FIG. 1*d* shows a connector 100 having the first set 114 and the second set 116 urged together by the resilient nature of the connector material itself, here shown as sheet metal. Particularly, the connector 100 in FIG. 1*d* has a pair of flanges 134, each extending from the top face 120 and the bottom face 122 on both sides of the connector 100. A separator 136 extending from each side of the body serves to push the flanges 134 apart from each other, thus forcing the first set 114 and the second set 116 away from each other. to insert the wire 130 into the connector 100. The first wire 130 in FIG. 1*c* is a hard wire which has a gauge of predetermined diameter. As noted above, the insulation around each wire is stripped before being inserted into the connector 100. However, each wire may be stripped while being inserted into the connector 100 if the ends 124 of the fingers 110 are sharp or serrated. The pressure applied to the finger 110 causes the finger 110 in each corresponding set to bend and accept the wire 130. The spring urge characteristics of the corresponding finger 110 allows the fingers 110 to hold the wire 130 in place and prevent the wire 130 from disengaging the connector 100. A second wire 132 having a larger gauge diameter, but same electrical potential as that of the first wire 130, is inserted at a different location in the connector 100 in the same manner. In effect, a connection is made between the two wires such that current is able to flow between the wires through the connector.

The wires 130 and 132 may be removed from the connector 100 by "opening" the connector 100. This is done by pressing the front back edge 128 and the bottom back edge 129 toward each other about the pivotal point 118. Opening the connector 100 provides enough clearance between the first set 114 and second set 116 to allow the user to remove the wires, as shown in FIG. 2*c*. Although hard wires are inserted by applying a force to the fingers 110, braided wires may not be able to be inserted into the connector 100 by force. In that case, the connector 100 is opened and a braided wire is then inserted.

Figure 2A:
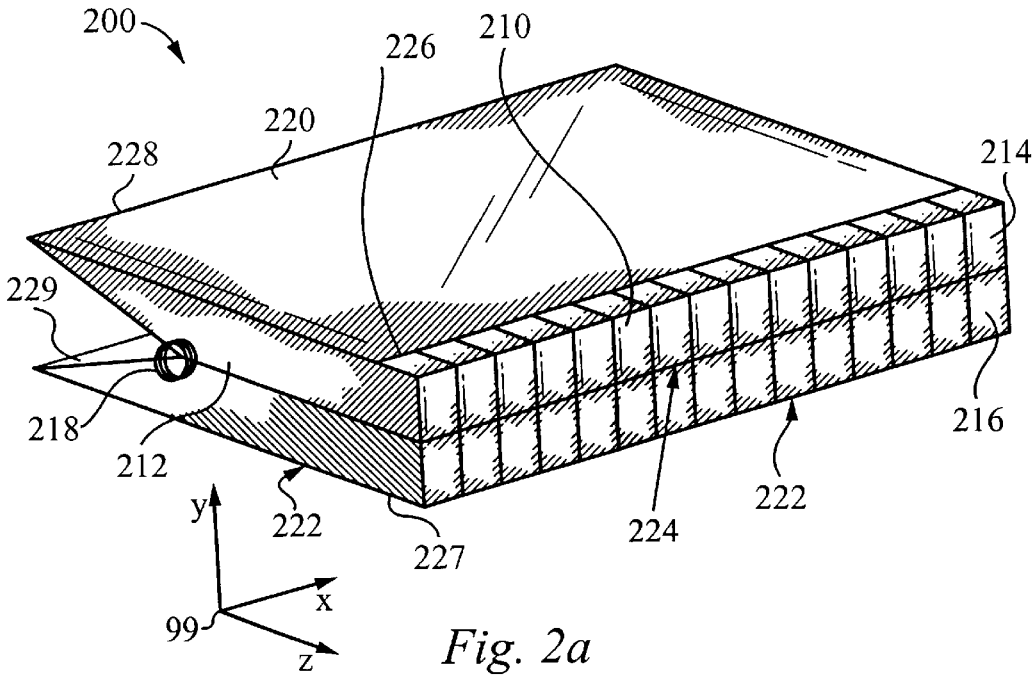
FIG. 2*a* shows an isometric view of an alternative embodiment of the connector were the fingers in the first set and the second set are parallel to plane 99.

FIG. 2*a* represents an alternate embodiment of the wire connector 200 in accordance with the present invention, which has a body 212, a first set of fingers 214, a second set of fingers 216, and a resilient means for keeping the first set of fingers 214 and the second set of fingers 216 in contact with one other. Each finger has an end 224 which serves as the connection point between the connector 200 and the wires inserted. Each finger 210 also has a spring urge characteristic such that the finger 210 will apply a resulting tension bias upon the wire which causes the finger 210 to move.

The body 212 has a top face 220 having a top front edge 226 and a top back edge 228. Also, the body 212 has a bottom face 222 having a bottom front edge 227 and a bottom back edge 229. The top front edge 226 has the first set of fingers 214 extending from it in a line and the bottom front edge 227 has the second set of fingers 216 extending from it in a line such that the ends 224 of each set are in contact with each other, forming an electrical node therebetween. There are also an equal number of fingers 210 in the first set 214 and the second set 216.

Each finger 210 in the first set 214 of this embodiment extends from the top front edge 226 and is configured at a ninety degree angle to be aligned with the plane 99, in which the plane 99 is substantially perpendicular to the top face 220. Similarly, the second set of fingers 216 extends from the bottom front edge 227 and is configured at a ninety degree angle to be aligned with the plane 99. Further, a resilient means urges the ends 224 of the fingers in the first set 214 to be in contact with the ends 224 of the fingers in the second set 216.

The resilient means is a coil spring mechanism incorporated in the body 212 about the pivotal point shown at 218. However, other body configurations can be utilized to act as an equivalent substitute for urging the ends of first set of fingers 214 to be in contact with the ends of the second set of fingers 216. As above, FIG. 2*d* shows a connector 200 having the first set 214 and the second set 216 urged together by the resilient nature of the connector being made of sheet metal. Particularly, the connector 200 in FIG. 2*d* has a pair of flanges 234, each extending from the top face 220 and the bottom face 222 on both sides of the connector 200. A separator 236 extending from each side of the body serves to push the flanges 234 apart from each other, thus forcing the top face 220 and bottom face 222, and therefore the first set 214 and the second set 216 away from each other.

Figure 2B:
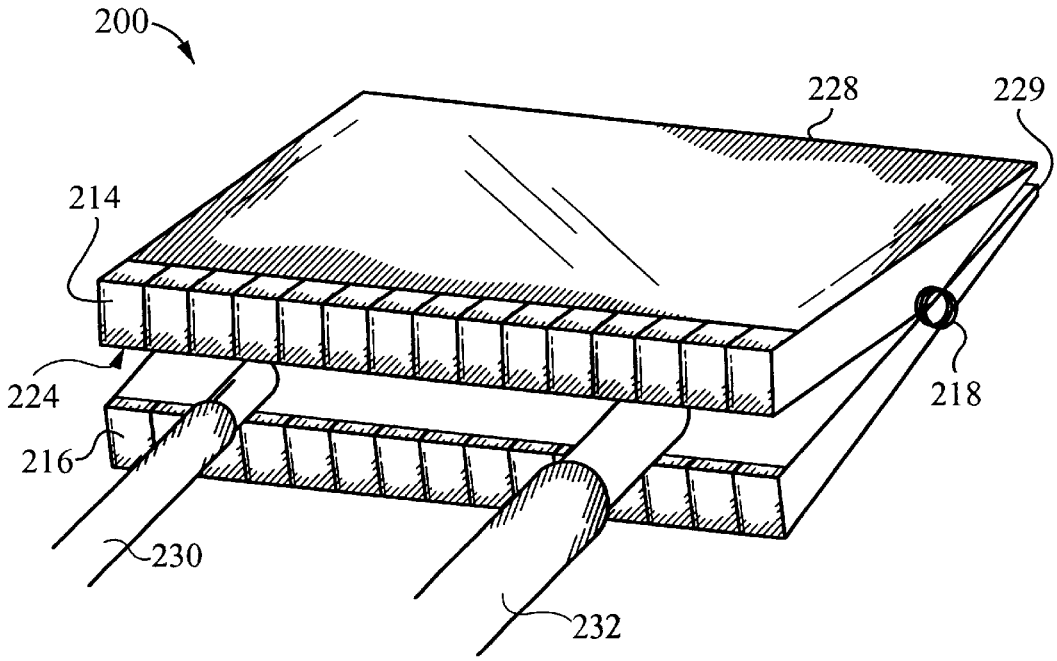
FIG. 2*b* shows an isometric view of the alternative embodiment of the connector in FIG. 2*a* in the "open" position for insertion or release of two wires of different gauge diameters into the connector.
Figure 2C:
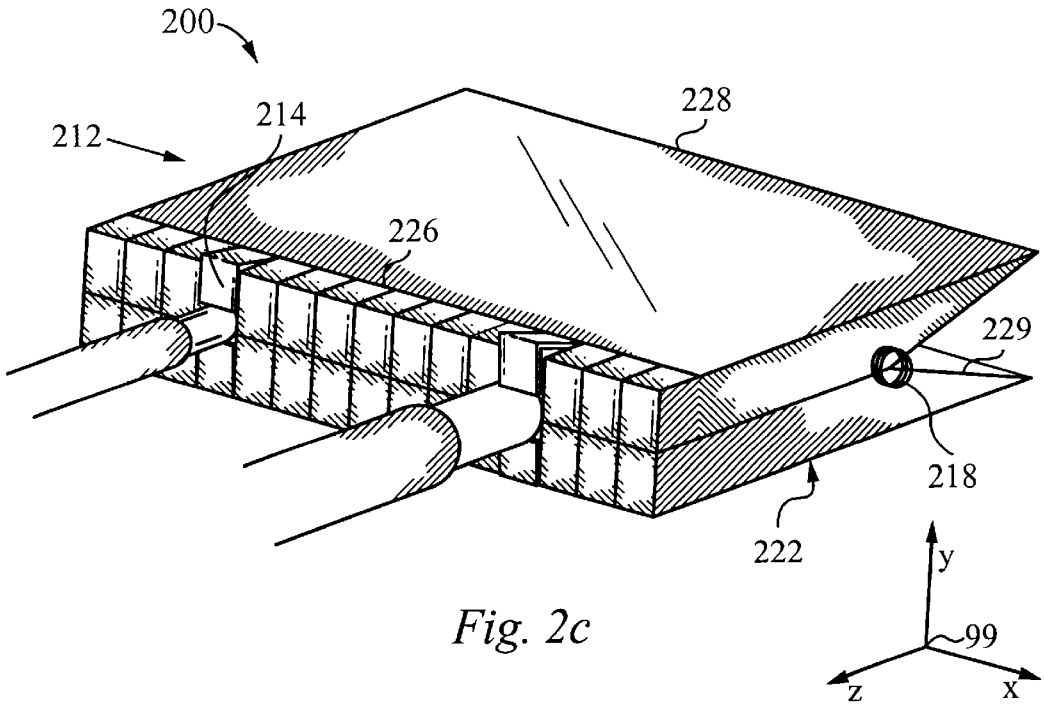
FIG. 2*c* shows an isometric view of the alternative embodiment of the connector with fingers in the first set and the second set parallel to the plane 99 with two wires of different gauge diameters inserted.
Figure 2D:
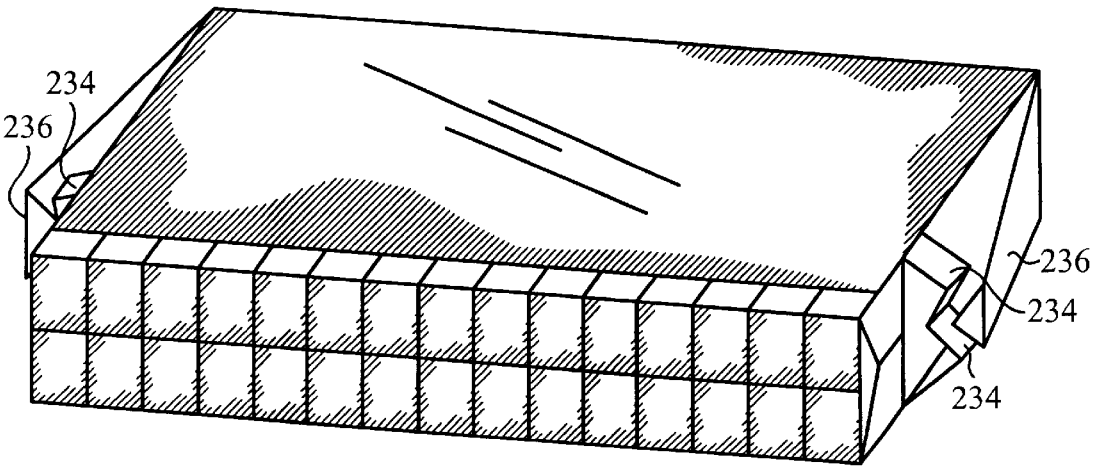
FIG. 2*d* shows an isometric view of the alternate embodiment of FIGS. 2*a*–2*c* with an alternate means to open.

As shown in FIG. 2*b*, the user inserts a braided wire by "opening" the connector 200. This is done by pressing the front back edge 228 and the bottom back edge 229 toward each other about the pivotal point 218. Opening the connector 200 provides enough clearance between the first set 214 and second set 216 to allow the user to insert a first wire 230 a larger gauged second wire 232. Once wires 230 and 232 are inserted, the user releases the connector 200 back to its original "closed" position. With the wires now inserted, as shown in FIG. 2*c*, between the fingers from the first and second set, a connection is present such that current may run between the wires 230 and 232 through the connector 200. Thus, the spring urge characteristic from each finger holds the wires 230 and 232 in their locations and prevents them from disengaging the connector 200. The wires 230 and 232 may be removed from the connector 212 in the same manner by "clamping open" the connector 200, as shown in FIG. 2*b*. Further, although braided wires are used as an example in this embodiment, any type of wire can be inserted into the connector 100.

Figure 3A:
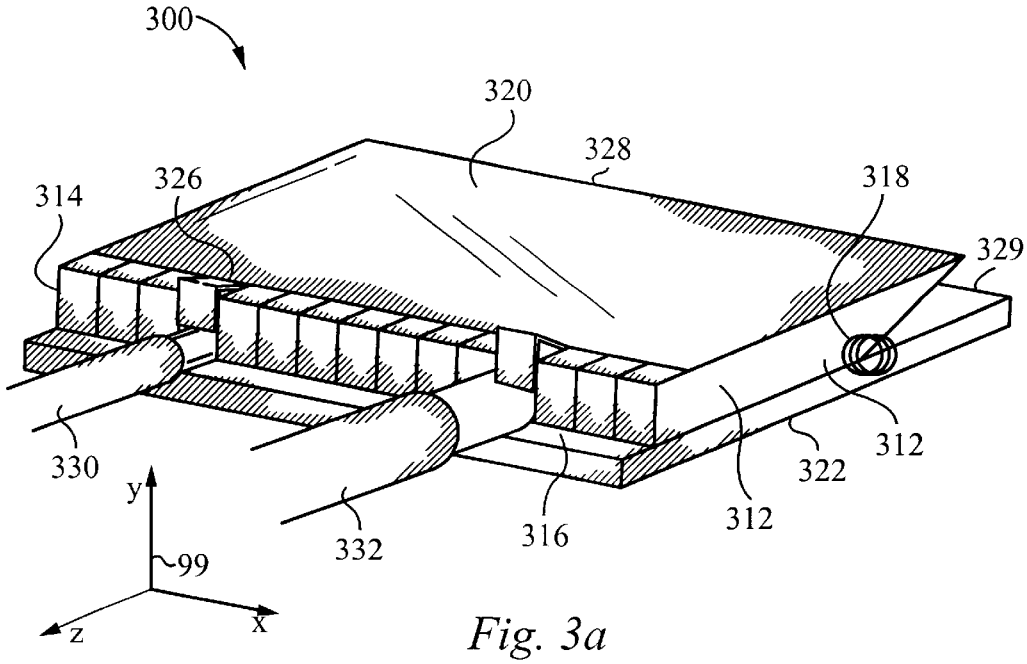
FIG. 3*a* shows an isometric view of an alternative embodiment of the connector with fingers in the first set and a plate in contact with the fingers where the fingers are parallel to plane 99 with two wires of different gauge diameters inserted.
Figure 3B:
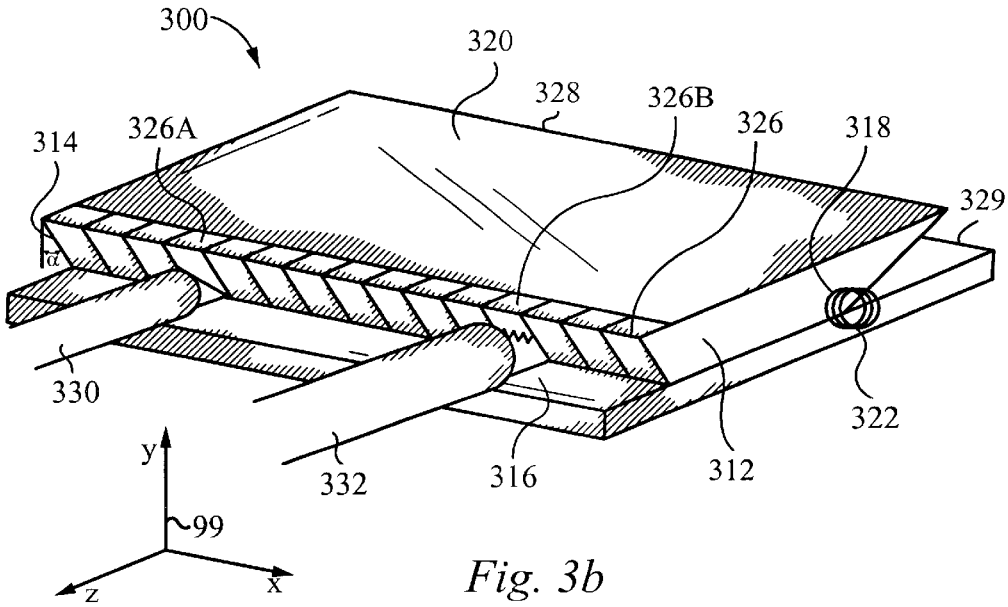
FIG. 3*b* shows an isometric view of an alternative embodiment of the connector with fingers in the first set and a plate in contact with the fingers where the fingers are at an angle α about plane 99 with two wires of different gauge diameters inserted.

FIGS. 3*a* and 3*b* represent alternative embodiments of the wire connector 300 in accordance with the present invention. Each of the alternate embodiments have a body 312, a first set of fingers 314, a plate 316, and a resilient means for urging the first set of fingers 314 and the plate 316 in contact with each other. Specifically, the body 312 has a top face 320 having a top front edge 326 and a top back edge 328. The bottom surface 322 comprises a plate 316, whereby the plate 316 is substantially parallel to the top face 320 and is configured to be in contact with the ends of first set 314.

A resilient means urges the first set 314 in contact with the plate 316. The resilient means is a coil spring mechanism incorporated in the body 312 about a pivotal point, shown at 318. As stated, other body configurations can be utilized to act as an equivalent substitute for urging the ends of first set of fingers 314 to be in contact with the ends of the second set of fingers 316.

Figure 3C:
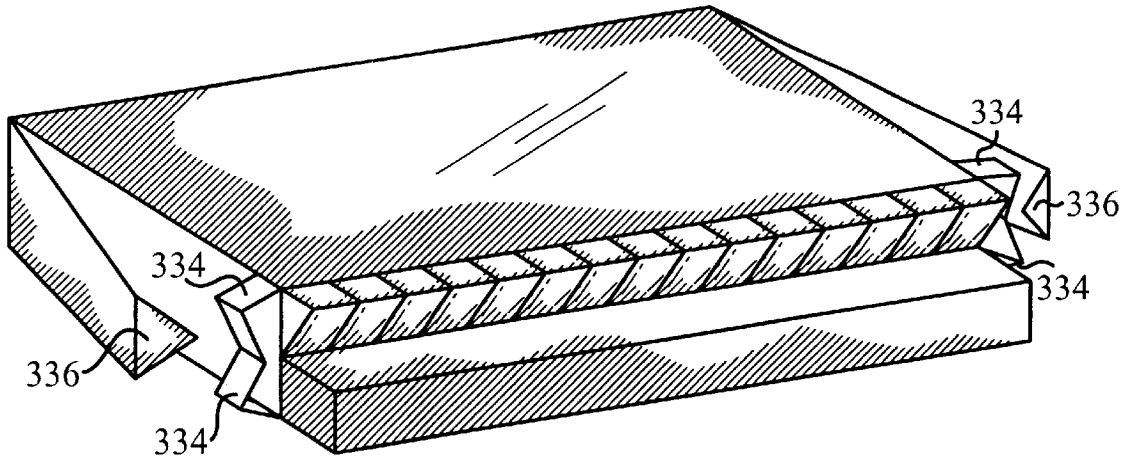
FIG. 3*c* shows an isometric view of an alternate embodiment of the connector of FIG. 3*a*.
Figure 3D:
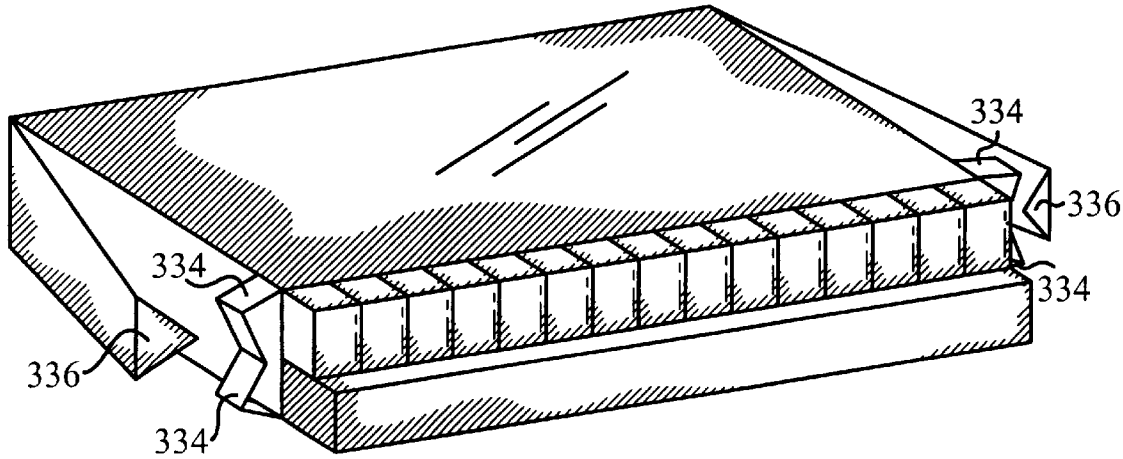
FIG. 3*d* shows an isometric view of an alternate embodiment of the connector of FIG. 3*b*.

For instance, FIGS. 3*c* and 3*d* show a connector 300 having the first set 314 and the plate 316 urged together by the resilient nature of the connector being made of sheet metal. Particularly, the connector 300 has a pair of flanges 334, each extending from the top face 320 and the bottom face 322 on both sides of the connector 300. A separator 336 extending from each side of the body serves to push the flanges 334 apart from each other, thus forcing the first set 314 and the second set 316 away from each other.

As shown in FIG. 3*a*, the first set of fingers 314 is configured to be parallel with the plane 99. To insert a wire, the user "clamps open" the connector 300 by pressing the top back edge 328 and the bottom back edge 329 toward each other about the pivotal point 318 to provide clearance between the first set of fingers 314 and the plate 316. Once wires 330 and 332 are inserted, the user releases the top and bottom surfaces to allow the resilient means to urge the connector back to its "closed" position. Thus, the fingers 310 engaging wires 330 and 332 are forced away from the plate 316 and the spring urge characteristic of the fingers 310 hold the wires 330 and 332 against the plate 316 and prevents the wires 330 and 332 from disengaging the connector 300. The wires 330 and 332 may also be removed from the connector 312 in the same manner by "clamping open" the connector 300.

In FIG. 3*b*, the fingers in the first set 314 extend from the top front edge 326 and are configured at angle $\alpha$ relative to the plane 99, whereby the plane 99 is substantially perpendicular to the top face 320. As in the preferred embodiment, the user inserts a first wire 330 having a gauge of predetermined diameter into the connector 300 by a slight force. The pressure applied to the finger 310 causes the finger 310 to bend and accept the wire 330. Further, the spring urge characteristic of the finger 310 urges the finger 310 to hold the wire 330 against the plate 316 and prevent the wire 330 from disengaging the connector 300. A second, larger gauged wire 332, is inserted at a different location in the connector 300 in the same manner. The wires 330 and 332 may be removed from the connector 300 by "clamping open" the connector 300 by pressing the top back edge 328 and the bottom back edge 329 toward each other about the pivotal point 318, as shown in FIG. 2*b*. Opening the connector 300 provides clearance between the first set 314 and the plate 316 to allow the wires 330 and 332 to be removed.

Although the present invention describes the first set of fingers 314 to be configured either parallel or at an angle $\alpha$ relative to the plane 99, the set 314 may comprise a combination of both configurations. In addition, the connector 300 described in FIGS. 3*a* and 3*b* may be attached to any sort of housing by an adhesive along the connector's top 320 or bottom surface 322.

In all the embodiments discussed above, the connector body and the fingers should be made of a highly conductive material to allow electricity to pass between the wires. Further, although only 2 wires are utilized in this embodiment, the invention can connect any number of wires with same or different gauges simultaneously. However, to prevent electrical shock, an insulating material is preferably incorporated around the outer surfaces of the body.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A connector comprising:

a. a body having a first surface and a second surface positioned parallel to a plane, wherein the first surface and the second surface are opposed to one another;

b. a first set of spring urged fingers extending from the first surface at an angle toward the second surface, the first set in electrical contact with one another, each finger in the first set having an end, such that ends of the first set are aligned substantially in a line;

c. a second set of spring urged fingers extending from the second surface at an angle toward the first surface, the fingers in the second set in electrical contact with one another and with the first set such that the first set and the second set form an electrical node, each finger in the second set having an end, such that ends of the second set are aligned substantially in the line and in contact with one or more of the ends of the first set at the plane;

d. resilient means for urging the ends of the first set into contact with the ends of the second set, the first set and the second set configured such that a first wire having a first gauge is insertable by pressure between the first set and the second set and a second wire having a second gauge is separately insertable by pressure between the first set and the second set wherein the first wire and second wire are substantially at a same electrical potential and are electrically connected to each other upon insertion in the connector; and e. an actuatable mechanism coupled to the body and configured to move the first surface away from the plane such that at least one of the inserted wires is removeable between the first set and the second set.

2. The connector according to claim 1 wherein the first gauge and the second gauge are different from one another.

3. The connector according to claim 1 wherein the first gauge and the second gauge are the same as one another.

4. The connector according to claim 1 wherein a third wire having a third gauge is insertable by pressure between the first set and the second set and the first wire, the second wire and the third wire are substantially at the same electrical potential.

5. The connector according to claim 1 wherein the third gauge of the third wire is different than at least one other wire.

6. The connector according to claim 1 wherein the third gauge of the third wire is the same with at least one other wire.

7. The connector according to claim 1 wherein the resilient means further comprises a coil spring mechanism.

8. The connector according to claim 1 the end of at least one finger is adapted to remove an insulating material surrounding the wire when the first or second wire is inserted between the first set and the second set.

9. A connector comprising:

a. a body having a first surface and a second surface positioned opposite to one another;

b. a first set of spring urged fingers configured along a plane, each finger in the first set having an end proximal to the first surface along the plane and an end distal to the first surface and having a bend of predetermined angle therebetween;

c. a second set of spring urged fingers, the second set configured parallel along the plane with the first set, each finger in the second set having an end proximal to the second surface along the plane and an end distal to the second surface and having a bend of predetermined angle therebetween, such that the distal ends of the second set are aligned substantially in a line and in contact with one or more of the distal ends of the fingers in the first set forming an electrical node; and d. resilient means for urging the distal ends of the first set into contact with the distal ends of the second set such that two or more wires having a substantially same electrical potential are separately insertable between the first set and the second set thereby causing the distal ends of the first set and the distal ends of the second set to engage the wires and provide electrical connection to the wires, wherein the fingers are individually moveable about the proximal end such that the bend in the first set and the second set of fingers are moveable away from each other to remove at least one inserted wire.

10. The connector according to claim 9 wherein the distal end of the first set of fingers and the distal end of the second set of fingers are configured at an angle relative to the plane and inward toward the body of the connector.

11. The connector according to claim 9 wherein at least one of the wires is a first wire having a first gauge and at least one of the wires is a second wire having a second gauge.

12. The connector according to claim 11 wherein one or more of the gauges is different from at least one other gauge.

13. The connector according to claim 11 wherein one or more of the gauge is the same as at least one other gauge.

14. The connector according to claim 9 wherein the resilient means further comprises a coil spring mechanism.

15. The connector according to claim 10 wherein at least one of the wires is a third wire having a third gauge is insertable by applied force between the first set and the second set wherein the third wire has the same electrical potential.

16. The connector according to claim 8 wherein a portion of the first set and a portion of the second set is configured parallel to the plane.

17. The connector according to claim 10 the end of at least one finger is adapted to remove an insulating material surrounding the wire when the wires are inserted between the first set and the second set.

18. A connector comprising:

a. a body having a first surface configured parallel to a plane, wherein the body includes a set of continuous spring urged fingers extending from the first surface at an angle, each finger in the set having an end such that ends of the set are aligned substantially in a line;

b. the body having a plate aligned parallel to the plane and in contact with the ends of the set such that the set and the plate form an electrical node;

c. the body having a resilient means for urging the contact between the ends of the set and the plate such that a first wire having a first gauge is insertable between the set and the plate and a second wire having a second gauge is separately insertable between the set and the plate, wherein the first wire and second wire are substantially at a same electrical potential and capable to pass electrical current therethrough when inserted; and d. an actuating mechanism coupled to the body and configured to actuate the first surface away from the plane, thereby providing clearance between at least one finger in the set and the plate to selectively remove at least one wire therebetween.

19. The connector according to claim 18 wherein at least a portion of the set is configured at an angle relative to the plane and inward toward the body.

20. The connector according to claim 19 wherein the first and the second wire is insertable by an applied force between the set and the plate.

21. The connector according to claim 18 wherein a portion of the set is configured parallel to the plane.

22. The connector according to claim 21 wherein at least one of the wires is a third wire having a third gauge is insertable between the set and the plate, the third wire having substantially the same electrical potential.

23. The connector according to claim 19 wherein at least one of the wires is a third wire having a third gauge is insertable by an applied force between the set and the plate, the third wire having substantially the same electrical potential.

24. The connector according to claim 22 wherein one or more wire gauge is different from at least one other wire gauge.

25. The connector according to claim 22 wherein one or more wire gauge is same as at least one other wire gauge.

26. The connector according to claim 18 wherein the resilient means further comprises a coil spring mechanism.

27. The connector according to claim 19 the end of at least one finger is adapted to remove an insulating material surrounding the wire when the first or second wire is inserted between the set and the plate.

28. A method of connecting a plurality of wires comprising the steps of:

a. providing a connector body having a first surface configured parallel to a plane and having a first set of spring urged fingers extending from the first surface at an angle, the first set in electrical contact with one another, each finger in the first set having an end, such that ends of the first set are aligned substantially in a line;

b. providing a second set of spring urged fingers extending from a second surface in the connector body, wherein the second surface is parallel to the plane, the second set in electrical contact with one another and with the first set such that the first set and the second set form an electrical node, each finger in the second set having an end, such that ends of the second set are aligned substantially in the line and in contact with one or more of the finger ends of the first set at the plane;

c. urging the ends of the first set into contact with the ends of the second set such that a first wire having a first gauge is insertable between the first set and the second set and a second wire having a second gauge is separately insertable between the first set and the second set wherein the first wire and second wire are substantially at a same electrical potential and are electrically connected to one another when inserted into the connector body; and d. coupling an actuating mechanism to the connector, wherein the actuating mechanism actuates the first surface away from the second surface such that at least one of the inserted wires is removeable between the first set and the second set.

* * * * *